US006009883A

United States Patent [19]

Morrow

[11] Patent Number: 6,009,883

[45] Date of Patent: Jan. 4, 2000

[54] HAIR STRAIGHTENING NOZZLE

[76] Inventor: Willie L. Morrow, 6333 Tooley St., San Diego, Calif. 92114

[21] Appl. No.: 09/121,200

[22] Filed: Jul. 22, 1998

[51] Int. Cl.[7] ..... A45D 7/02

[52] U.S. Cl. ..... 132/211; 132/272; 34/98; 34/283

[58] Field of Search ..... 132/211, 118, 132/271, 272, 269; 34/283, 96, 97, 98, 101

[56] References Cited

U.S. PATENT DOCUMENTS

| | | | |
|---|---|---|---|
| 3,939,850 | 2/1976 | Wahl | 34/96 |
| 4,254,324 | 3/1981 | Vrtaric | 34/98 |
| 4,721,121 | 1/1988 | Adams | 34/98 |
| 4,955,145 | 9/1990 | Scivoletto | 132/271 |
| 5,064,993 | 11/1991 | Hashimoto | 132/118 |
| 5,729,907 | 3/1998 | Santhouse et al. | 34/98 |
| 5,738,121 | 4/1998 | Westerveld | 132/118 |

*Primary Examiner*—Todd E. Manahan
*Attorney, Agent, or Firm*—Eastman & Associates

[57] ABSTRACT

The Hair Straightening Nozzle of the present invention includes a nozzle suitable for attachment to a typical hand-held hair blow dryer, and is formed with two parallel rows of teeth disposed on opposite sides of the nozzle such that the air from the hair blow dryer passes from the nozzle, through the nozzle opening, and between the two rows of teeth. A heating bar is located between the rows of teeth and in the stream of heated air, and is formed of a heat-conducting material, such as steel. The heating bar, heated by the heated air passing through the nozzle, extends slightly higher than the base of the teeth, such that as the teeth are pulled through the hair, the hair passes over the heating bar and the heated bar straightens the hair.

7 Claims, 5 Drawing Sheets

HAIR STRAIGHTENING NOZZLE

BACKGROUND OF THE INVENTION

The present invention relates generally to hair care products. More particularly, though not exclusively, the present invention relates to a blow dryer nozzle used for straightening naturally curly hair.

Hair generally is formed with a cuticle (the outer layer), a cortex (an inner layer), and a medulla (the innermost layer). The spiraling nature of naturally curly hair, particularly African American hair, is caused by the shaft of the hair having a flat cross-section. Additionally, the cuticle of the hair serves to maintain the curly nature of the hair through a thick and durable covering of keratin proteins.

It has often been a desire of people having curly hair to straighten their hair, such as by combing and/or brushing the hair. A number of combs have been designed specifically for use with curly hair, such as the Afro pick, and a comb having holes along the spine of the comb to allow the hair a space to turn and unwind. Despite these straightening actions, however, the hair is only pulled straight for an instant, and due to the curly nature of the hair, the hair returns to its original curvature.

In order to keep the hair in a straightened state, a chemical relaxer is often applied to the hair. Chemical relaxers typically consist of a strong alkaline chemical, such as lye, and require that hair care technicians exhibit a great deal of caution in order to avoid damaging the hair, or burning the scalp of the person being treated. Moreover, due to the harshness of the chemical relaxers, it is important that the chemicals are only left on the hair for a limited period of time. In fact, chemicals left on the hair too long may even result in the hair breaking.

As an alternative to the chemical straighteners, the hair may be straightened by pressing and curling the hair. Pressing includes the application of extreme heat to the hair in order to "press out" the curls. One device used in the pressing process is a pressing comb, also known as the straightening comb. The pressing comb is made of a heavy metal and formed with a single row of teeth. The heavy metal material allows for the comb to be heated, such as by placing the comb in a heating device, and then retains the heat during the combing process. In this manner, the hair is heated and combed straight at the same time, resulting in the hair remaining in its straightened state. However, with moisture, the hair will revert back to its natural, curly state, necessitating the hair being straightened again. Consequently, it is possible that a person having curly hair could need to straighten their hair several times a week.

As an alternative to the pressing comb, a nozzle for use with a typical hand-held blow dryer was first introduced for use in straightening out the curl of the African American hair in the 1970's. A thorough discussion of the nozzle and the associated techniques for straightening hair, is included in the 1993 book entitled *Cosmetology: The Art and Science of Curly Hair* which was written by Willie L. Morrow, the Inventor of the present invention, and is fully incorporated herein by this reference.

The blow dryer nozzle was formed with two rows of teeth which were separated in order for the air from the hair dryer to flow between the teeth to heat the hair during the combing process. While this nozzle provided a localized heating for the rapid evaporation of any moisture within the hair, it was considerably cooler than the straightening comb, and thus did not provide the same straightening effect.

In light of the above, it is an object of the present invention to provide a blow dryer nozzle which is capable of providing a higher temperature for the straightening of the hair during the blow drying process. It is a further object of the present invention to provide a blow dryer nozzle which is attachable to any blow dryer, and which is relatively easy to manufacture and comparatively cost effective.

SUMMARY OF THE INVENTION

The Hair Straightening Nozzle of the present invention includes a nozzle suitable for attachment to a typical hand-held hair blow dryer. The nozzle is formed with two parallel rows of teeth disposed on opposite sides of the nozzle such that the air from the hair blow dryer passes from the nozzle, through the nozzle opening, and between the two rows of teeth. Attached to the nozzle and positioned between the two rows of teeth and parallel to the teeth is a heating bar. The heating bar is located in the stream of heated air and is formed of a heat-conducting material, such as steel. The steel heating bar, heated by the heated air passing through the nozzle, extends slightly higher than the base of the teeth for striking the hair within the teeth. In this manner, the teeth may be pulled through the hair and, as the hair passes through the teeth, the hair passes over the heating bar. As the hair passes over the heating bar, the heated bar straightens the hair, much like the effects of using a traditional straightening comb.

DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION

Figure 1:
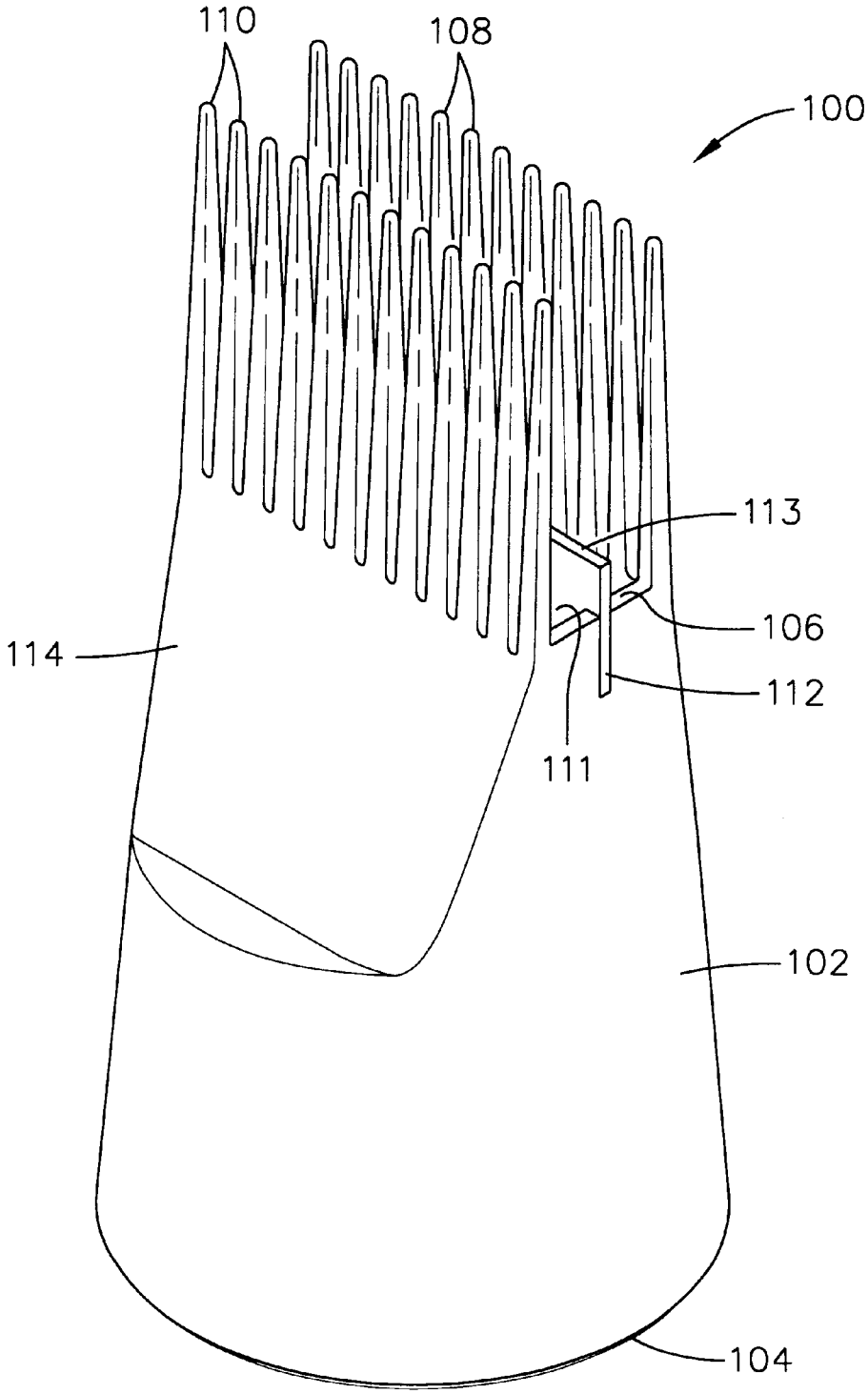
FIG. 1 is a perspective of the Hair Straightening Nozzle of the present invention showing the base of the nozzle formed to be positioned over a typical hand-held hair dryer, the two rows of teeth, and the raised heating bar positioned to contact the hair as it is pulled between the two rows of teeth.

Referring first to FIG. 1, the Hair Straightening Nozzle of the present invention is shown and generally designated 100. Nozzle 100 includes a hollow body 102 having a base 104 and a tapered outlet 106. The base 104 is sized to receive a standard hair dryer nozzle and to be attached thoroughly thereto. The tapered outlet 106 has a smaller cross-section than the base in order to provide a concentration of the heated air to a smaller area. In a preferred embodiment, the cross-sectional area of the base is approximately 5 square inches, and the cross-sectional area of the tapered outlet is approximately 1 square inch. Consequently, the velocity of the air passing out the tapered outlet is about five (5) times greater than the velocity of air delivered from the hair dryer nozzle.

Figure 2:
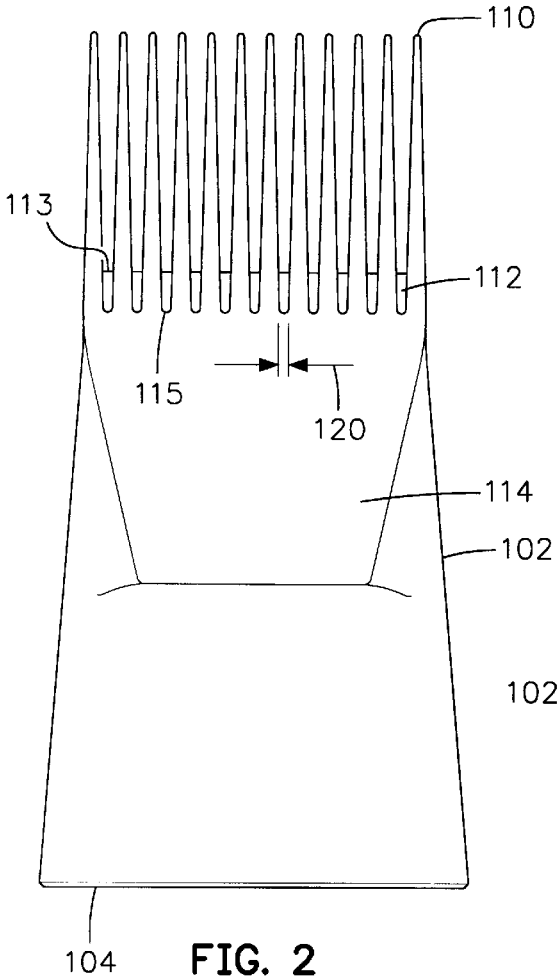
FIG. 2 is a front view of the Hair Straightening Nozzle of the present invention showing a row of teeth having sufficient spacing to allow the passing of a person's curly hair through the teeth.

Referring to FIG. 2, two rows of teeth 108 and 110 are positioned along the sides of outlet 106 such that when the Nozzle 100 is used to dry a person's hair, the hair extending between the rows of teeth 108 and 110 are exposed to the heated air. Moreover, due to the increased velocity of the heated air, the hair extending between the two rows of teeth is exposed to a higher temperature air stream. In a preferred embodiment, the teeth 108 and 110 are made of a plastic material which, in addition to its ease of manufacturing, does not retain or conduct heat.

Outlet 106 is equipped with a heating bar 112 which extends across the airspace 111 of outlet 106, and between the two rows of teeth 108 and 110. In a preferred embodiment, heating bar 112 is embedded into body 102 such that the heating bar is rigidly held in position. Preferably, heating bar 112 is made of a metallic material which conducts and retains heat, such as steel. It should be appreciated, however, that virtually any material may be used for heating bar 112 so long as the material will not melt when exposed to the extreme heat generated by the blow dryer.

Figure 3:
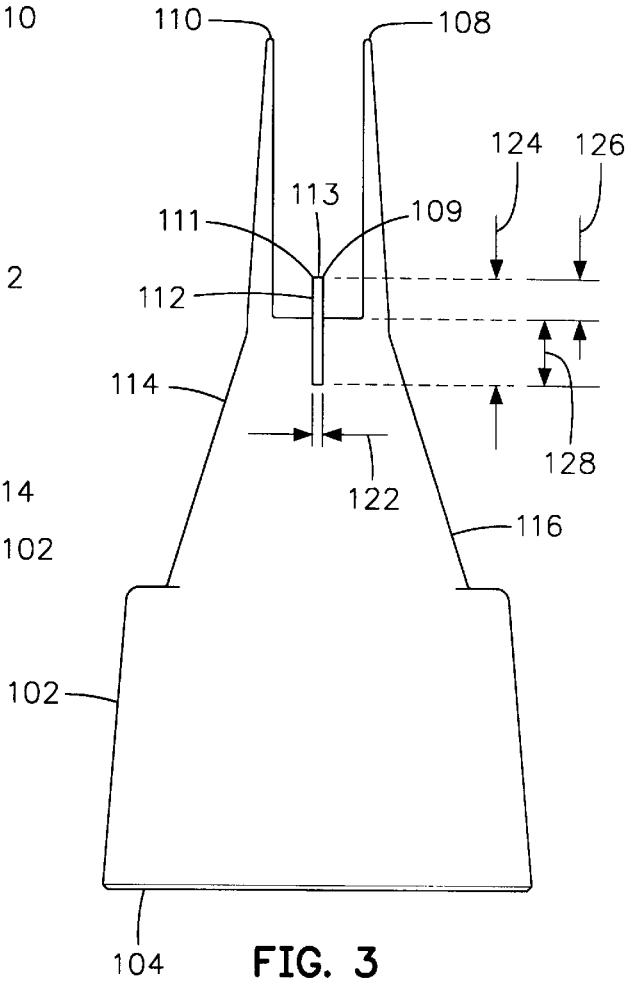
FIG. 3 is a side view of the Hair Straightening Nozzle of the present invention showing the placement of the heating bar between the two rows of teeth such that when the hair is passed through the teeth, the hair contacts the heating bar and is straightened.

Referring now to FIG. 3, the heating bar 112 includes a leading edge 109, a trailing edge 111, and a contact surface 113. In order to eliminate any burrs or sharp edges on the contact surface 113 of metal heating bar 112, the bar may tumbled or sanded as is known in the art. The absence of sharp edges is of a particular importance due to the potential for catching or cutting any hair as it passes over the heating bar. Heating bar 112 has a height 124, and is embedded into body 102 a distance 128 to allow the heating bar to extend upwards a distance 126. This distance 126 is important as the heating bar 112 must extend above the lower end 115 of the gaps 120 such that the hair will contact the contact surface 113 as it is drawn between the teeth 108 and 110.

In a preferred embodiment, the height 124 of the heating bar is approximately one (1) inch, and extends about three-eighths (3/8) inch above the outlet 106. Also in a preferred embodiment, heating bar 112 has a thickness 122 on the order of 0.058 inches, and is made of an aluminum alloy. Although specific measurements of a preferred embodiment are set forth herein, such measurements are in no way limiting, and any permutations and/or combinations are fully contemplated herein.

It should be appreciated that the distance 120 between the teeth, or gap, may be increased or decreased. For example, when straightening hair that is only moderately curly, a Hair Straightening Nozzle having a smaller gap 120 may be used. On the other hand, when straightening hair that is very curly and/or thick, a Hair Straightening Nozzle having a larger gap 120 may function better. The smaller the gap 120, the greater number of teeth may be incorporated into the Hair Straightening Nozzle. Conversely, the greater the gap 120, the fewer number of teeth that will fit on the Hair Straightening Nozzle. In any case, a Hair Straightening Nozzle having any gap 120 is contemplated fully herein.

Figure 4:
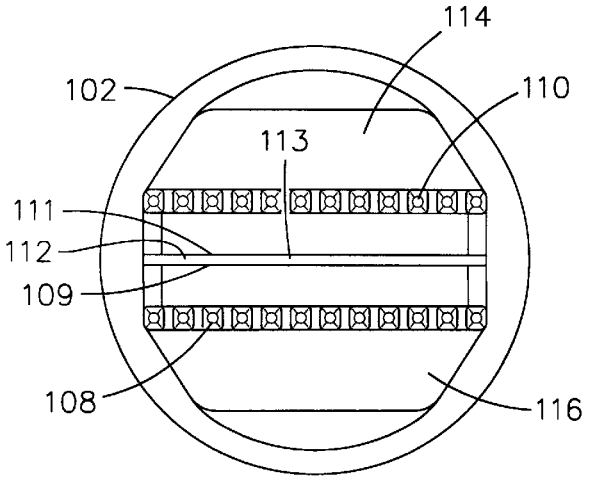
FIG. 4 is a top view of the Hair Straightening Nozzle of the present invention showing the parallel placement of the heating bar within the nozzle opening between the two rows of teeth, and the spacing between the teeth.
Figure 5:
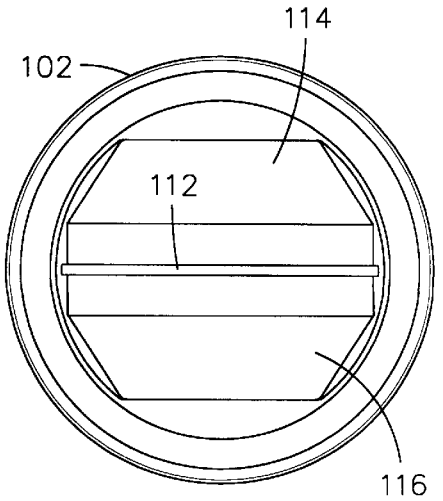
FIG. 5 is a bottom view of the Hair Straightening Nozzle of the present invention showing the reduction in cross-sectional area between the lower end of the nozzle and the portion of the nozzle adjacent the heating bar.

Referring to FIGS. 4 and 5, the Hair Straightening Nozzle 100 is shown from the top and bottom, respectively. As can be appreciated from these Figures, airspace 111 has a much smaller cross-sectional area than base 104, resulting in the increased air velocity discussed above. Also, the tapering of panels 114 and 116 are apparent, serving to provide a gradual decrease in the cross sectional dimensions of the body 102 thereby creating an even air flow through outlet 106.

USE OF A PREFERRED EMBODIMENT

Figure 6:
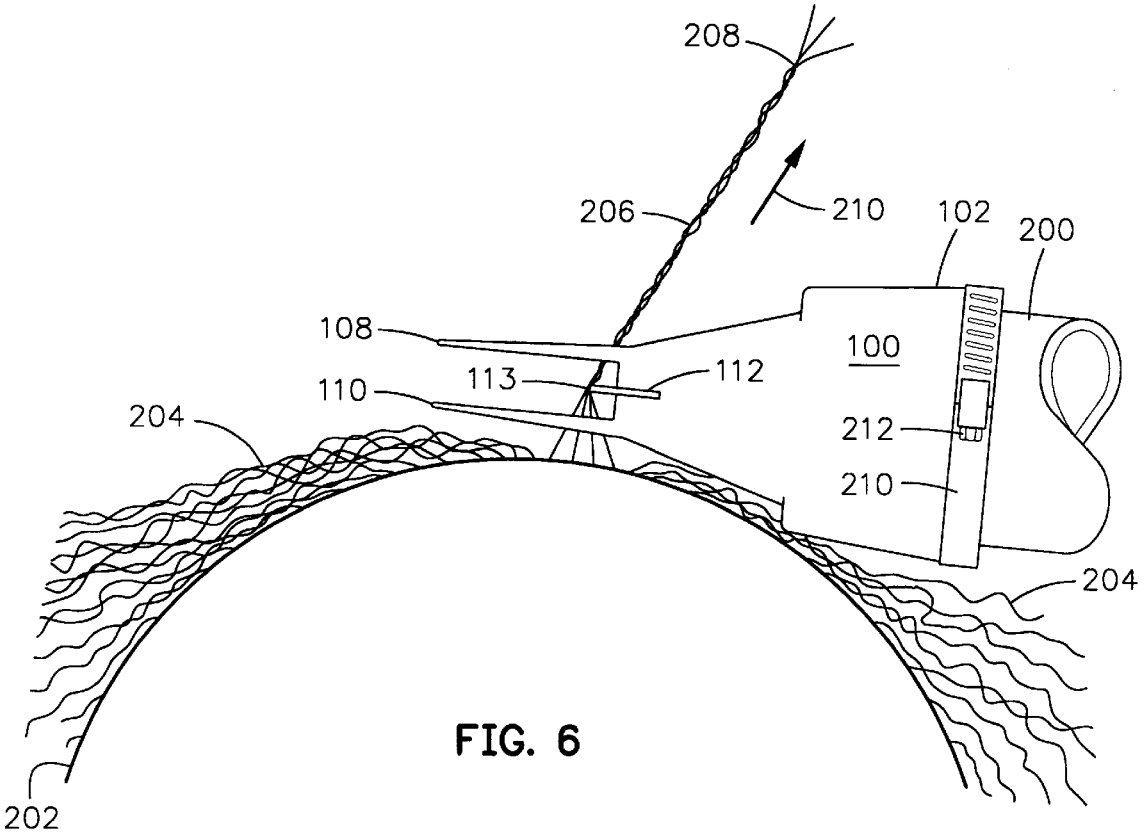
FIG. 6 depicts use of the Hair Straightening Nozzle of the present invention as used to straighten hair, showing the positioning of the nozzle and heating bar against the hair.

Referring now to FIG. 6, use of the Hair Straightening Nozzle 100 of the present invention is shown. Hair Straightening Nozzle 100 is attached to a blow dryer 200, and teeth 110 are positioned adjacent a person's scalp 202 having curly hair 204. As the teeth 110 are pushed through hair 204, a number of strands 206 are pulled through the upper teeth 108 such that the hairs 206 strike contact surface 113 of heating bar 112. The Hair Straightening Nozzle 100 is then moved along hairs 206 in direction 210 from the scalp 202 to the ends 208 of the hairs 206. In this manner, as the hairs strike the heating bar, the hairs are sufficiently heated to remove most if not all of the curl.

The Hair Straightening Nozzle of the present invention has a very important safety feature, namely, that the person having their hair straightened is never exposed to, or comes in contact with, a surface capable of producing burns. More specifically, referring still to FIG. 6, during the use of the Hair Straightening Nozzle to straighten a person's hair, the row of teeth 110 is positioned against the person's scalp. In this position, the air being forced from the nozzle is directed parallel to the person's scalp, instead of directly at the scalp. Consequently, no heated air is directed toward the scalp, effectively eliminating the possibility of the person being burned by the hot air. Moreover, although the heating bar 112 becomes very hot during use of the Hair Straightening Nozzle, because it is positioned between the two rows of teeth 108 and 110, it is impossible for the heating bar to contact the person. The inability of the Hair Straightening Nozzle of the present invention to cause burns during its use is a particular advantage over prior art hair straighteners.

Hair Straightening Nozzle 100 may be equipped with a clamp 210 for attachment to the blow dryer nozzle 200. Once the Hair Straightening Nozzle 100 and clamp are positioned over the blow dryer 200, screw 212 may be tightened to secure base 102 around the dryer 200. In order to accommodate blow dryers having differing nozzle diameters, a series of spacers (not shown) may be provided which will accept the nozzles having different diameters.

OTHER EMBODIMENTS

Figure 7:
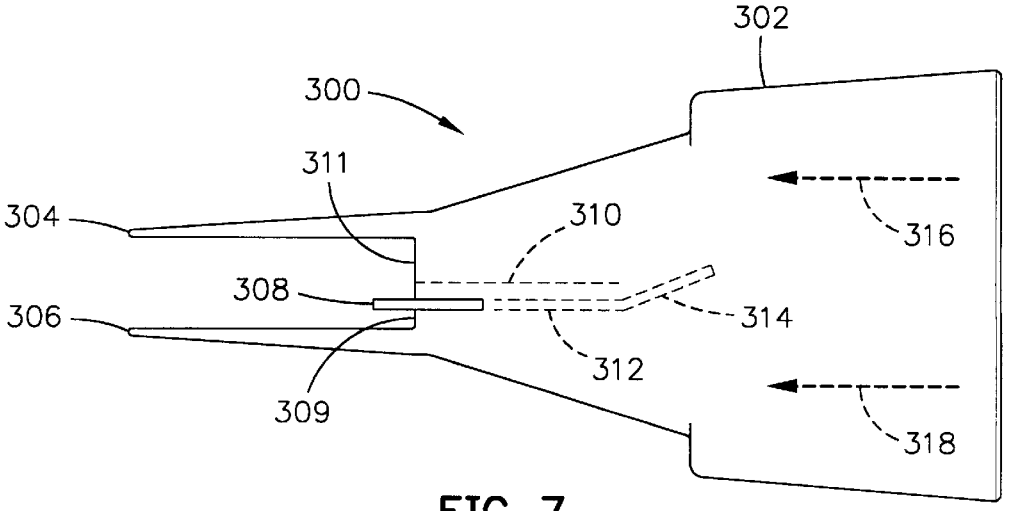
FIG. 7 is a side view of an alternative embodiment of the Hair Straightening Nozzle of the present invention showing an off-center placement of the heating bar within the nozzle opening, and showing a heating bar having a bent portion to increase the air flow adjacent the heating bar.

Referring now to FIG. 7, an alternative embodiment of the Hair Straightening Nozzle of the present invention is shown and generally designated 300. Nozzle 300 includes a base 302 and a pair of rows of teeth 304 and 306. Between rows of teeth 304 and 306, heating bar 308 is positioned about half way between the median line 310 and row of teeth 306. In this position, heating bar 308 separates the air flow 316 and 318 into an upper flow 311 and a lower flow 309. It has been determined through experimentation and analysis that the temperature of air in the lower air flow 309 is significantly hotter than the air flow 311. In fact, the temperature of the air in the lower air flow 309 has been measured at twice the temperature of the upper air flow 311. This is particularly beneficial as the heating bar 308 acquires substantially the same temperature as the air passing around it, resulting in a hotter heating bar. A hotter heating bar provides for a more effective straightening of the hair, and consequently works much more rapidly than other hair straightening devices.

The heating bars discussed herein are shown as flat pieces of heat-conducting metal, and these shapes have been determined to minimize the formation of any back-pressure within the nozzle body. However, it is to be appreciated that the actual shape of the heating bar, and the material from which it is made, may be varied. For example, instead of the metallic plate of heating bar 308, the heating bar may be a ceramic rod which extends through the aperture of the nozzle and is positioned to contact the hair.

In addition to providing a hotter heating bar 308, the positioning of the heating bar closer to the row of teeth 306 allows the person to straighten their hair closer to the scalp. This feature may be appreciated by comparing the Hair Straightening Nozzle 100 shown in FIG. 6, to the Hair Straightening Nozzle 300 of FIG. 7. More particularly, since the heating bar 308 is closer to the row of teeth 306, the hair 206 strikes the heating bar closer to the person's scalp 202, resulting in hair that is straightened nearly all the way to the scalp.

In an alternative embodiment, Hair Straightening Nozzle 300 may include an elongated heating bar, shown with dashed lines 312. This elongated heating bar would provide for a more complete heat exchange, resulting in a still hotter heating bar 308. In fact, because the heating bar extends into the body 302 even further, the air flow 316 and 318 is passed into flow 309 in an even greater proportion. To further divert this air flow 316 and 318 into flow 309, a diverter panel 314 may be added to heating bar 308. This diverter panel 314 serves to divert air flow 316 from flow 311 and into flow 309, resulting in a flow 309 which is faster moving and hotter than other air flows.

Because it is advantageous to begin straightening hair as close to the scalp as possible, teeth 306 of Hair Straightening Nozzle 300 should be placed against the scalp of the person having curly hair. This would result in the heating bar 112 striking the hair as close to the scalp as possible without causing any burns or damaging the person's hair like the prior art devices.

Figure 8:
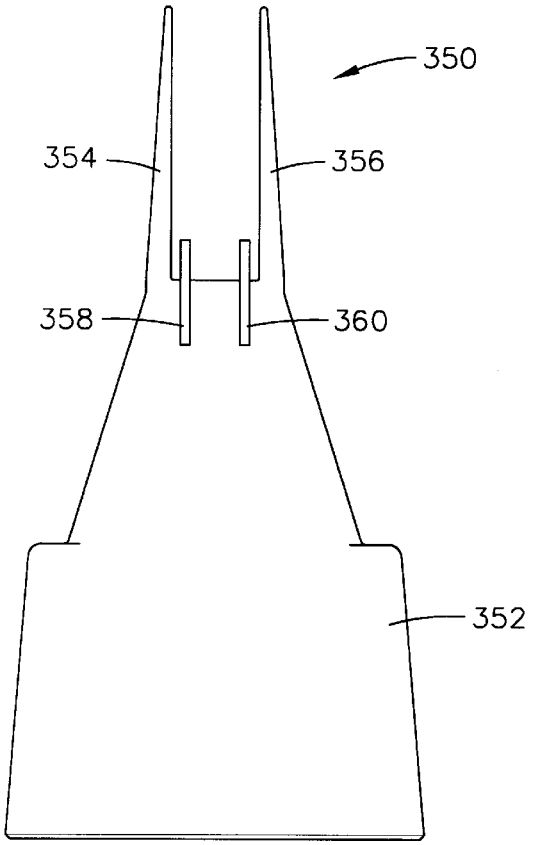
FIG. 8 is a side view of an alternative embodiment of the Hair Straightening Nozzle of the present invention showing a pair of heating bars, with one heating bar adjacent each row of teeth.

Referring now to FIG. 8, an alternative embodiment of the Hair Straightening Nozzle of the present invention is shown and generally designated 350. Hair Straightening Nozzle 350 includes a body 352 and a pair of teeth rows 354 and 356. Between the rows of teeth 354 and 356, a pair of heating bars 358 and 360. This pair of heating bars creates a Hair Straightening Nozzle 350 which may be used with either row of teeth 354 or 356 closest to the scalp.

Figure 9:
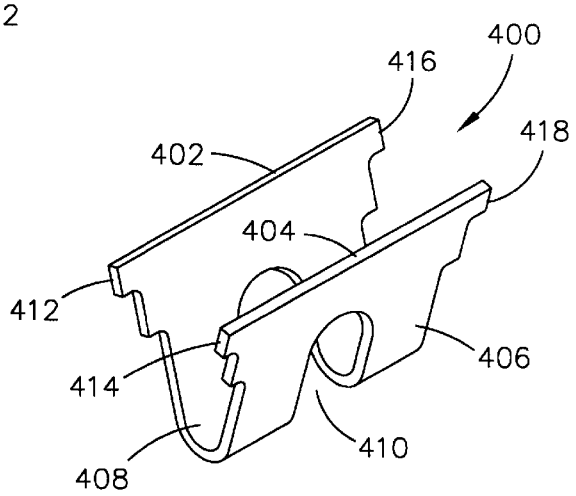
FIG. 9 is a heating bar that may be inserted into a nozzle to form an alternative embodiment of the Hair Straightening Nozzle.

In addition to fixedly attaching a heating bar to a blow dryer nozzle, an insertable heating bar may be provided in accordance with the present invention. Such an insertable heating bar is shown in FIG. 9 and generally designated 400. Heating bar insert 400 includes a first heating bar 402, a second heating bar 404, and a pair of spring connectors 406 and 408. Importantly, spring connectors 406 and 408 are spaced apart to form an air flow passage 410 which allows air to flow through the passage and out between the two heating bars 406 and 408. The heating bar insert 400 may be formed with a number of positioning tabs 412, 414, 416 and 418 which help to maintain the heating bar insert in the proper position within a blow dryer nozzle.

Figure 10:
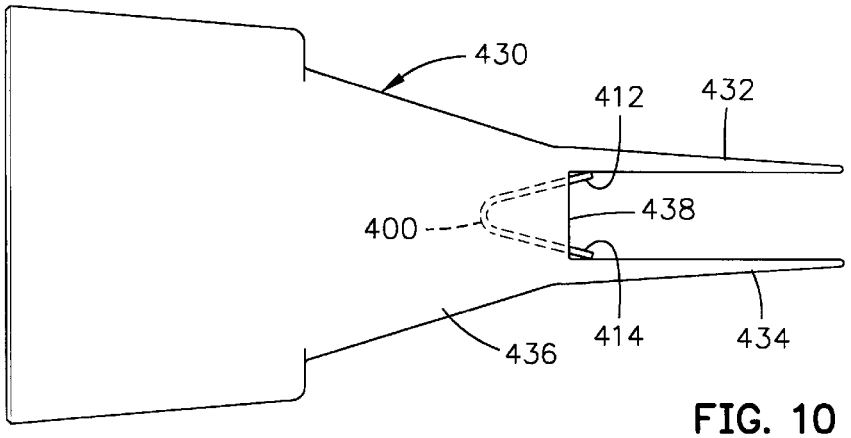
FIG. 10 is a Hair Straightening Nozzle equipped with the heating bar insert of FIG. 9.

FIG. 10 shows the heating bar insert 400 of FIG. 9 as inserted into the nozzle 430. Nozzle 430 is formed with two rows of teeth 423 and 434. To install heating bar insert 400 into nozzle 430, the two heating bars 402 and 404 are pinched together such that the spring connectors 406 and 408 may be inserted between the rows of teeth 432 and 434 and into the nozzle body 436. The heating bar insert 400 is inserted into the nozzle body 436 until positioning tabs 412 and 414 engage outlet 438. Once in position, the heating bars 402 and 404 are released and allowed to spring back towards their original positions such that the heating bars 402 and 404 rest against the inside surface of the rows of teeth 432 and 434. The operation of the nozzle having the heating bar insert is similar to the use of the Hair Straightening Nozzle 100.

Figure 11:
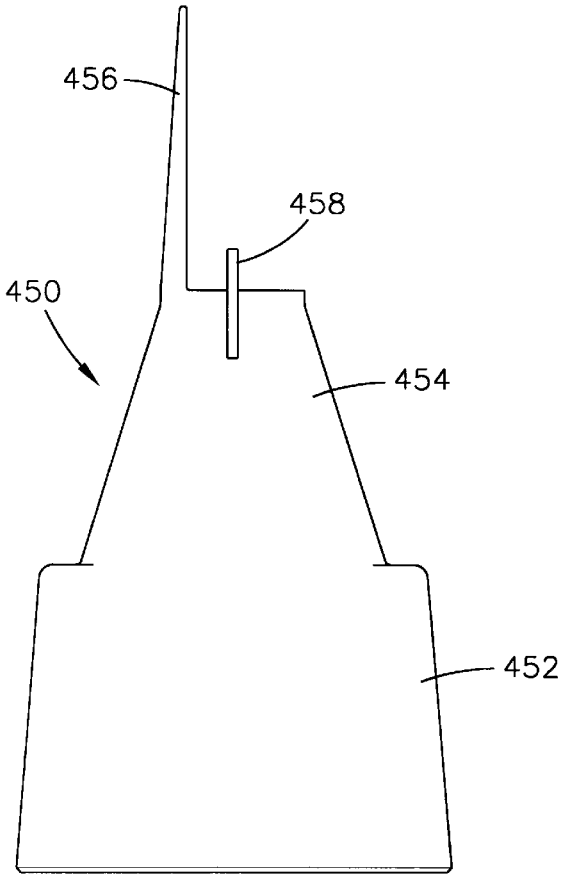
FIG. 11 is another alternative embodiment of the Hair Straightening Nozzle of the present invention having a single row of teeth and having a heating bar positioned near the row of teeth.

FIG. 11 shows an alternative embodiment of the Hair Straightening Nozzle of the present invention generally designated 450. Hair Straightening Nozzle 450 is formed with a body 452 and a tapered section 454 and is equipped with a heating bar parallel to a single row of teeth 456. Despite having only a single row of teeth, Hair Straightening Nozzle 450 is used much like the straightening devices discussed above.

Figure 12:
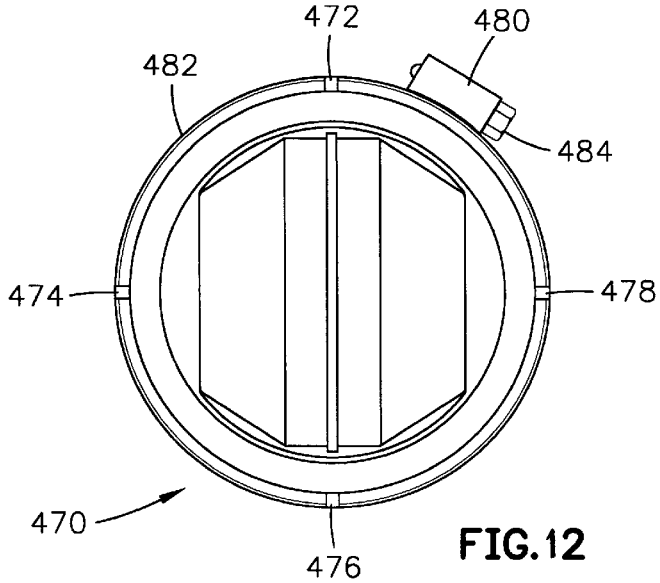
FIG. 12 is a bottom view of the Hair Straightening Nozzle of the present invention equipped with a means for securing the Nozzle on the hair dryer.

Referring now to FIG. 12, the bottom portion of a Hair Straightening Nozzle of the present invention is shown and generally designated 470. Hair Straightening Nozzle is formed with a series of four compression slits 472, 474, 476, and 478. A band 482 surrounds the base of Hair Straightening Nozzle 470 such that as clamp 480 is tightened by turning screw 484, the band shortens to compress the compression slits in order to hold the Hair Straightening Nozzle 470 on a hair dryer nozzle. Although a band clamp, often called a worm clamp, is disclosed in a preferred embodiment, it should be appreciated that any means for attaching the Hair Straightening Nozzle to a hair dryer is fully contemplated herein.

Figure 13:
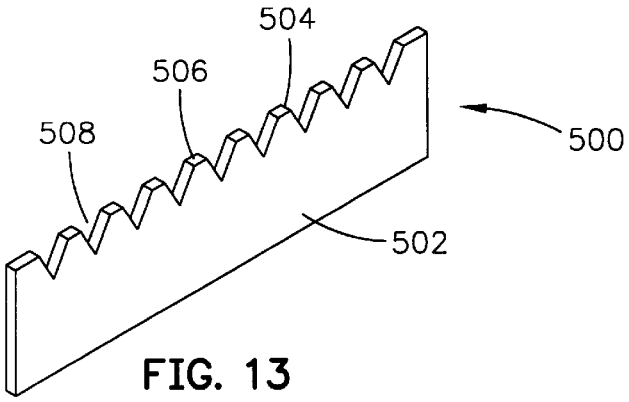
FIG. 13 is a perspective view of an alternative embodiment of a heating bar of the present invention.

As an alternative to the smooth heating bars disclosed above, an alternative heating bar is shown in FIG. 13 and generally designated 500. Heating bar 500 includes a body having a number of teeth 504 separated by gaps 508. Because the hair is actually in contact with the heating bar 500, it is important that the points of the teeth 504 are not sharp, and that the spaces between the teeth are sufficiently large to prevent the hair from becoming entangled or caught in the heating bar. Although a particular configuration of teeth is shown in FIG. 13, it is to be appreciated that virtually any configuration of teeth is contemplated herein, and such configurations may include a heating bar with teeth that are wide, narrow, short, long, or any other shape.

While there have been shown what are presently considered to be preferred embodiments of the present invention, it will be apparent to those skilled in the art that various changes and modifications can be made herein without departing from the scope and spirit of the invention.

I claim:

1. A Hair Straightening Device comprising:

a body having a base and a nozzle opening having an aperture, the body formed with a bore extending from the base to the nozzle opening, the base sized for attachment to a blow-dryer;

a plurality of teeth extending from the nozzle opening; and a heating bar having a leading edge, a trailing edge and a smooth contact surface therebetween, the heating bar aligned with the heated air flow positioned within the nozzle opening, wherein as one or more of the plurality of teeth are passed through a person's hair, the hair is drawn over the leading edge and the smooth contact surface where the heating bar contacts the hair and is straightened by the heat transmitted from the smooth contact surface and by the action of being drawn across the leading edge.

2. The Hair Straightening Device of claim 1, further comprising a second row of teeth extending from the nozzle opening and positioned across the aperture from the row of teeth and substantially parallel thereto.

3. The Hair Straightening Device of claim 2, wherein the heating bar is closer to the row of teeth than the second row of teeth.

4. A Hair Straightening Device, comprising:

a means for generating heated air;

a nozzle attached to the means for generating heated air;

at least one row of teeth extending from the nozzle; and a heating bar having a leading edge, a trailing edge and a smooth contact surface therebetween, the heating bar adjacent to at least one row of teeth, wherein the leading edge and the smooth contact surface of the heating bar contacts a person's hair as the hair straightening device is passed through the hair thereby straightening the hair by drawing the hair across the leading edge and by transmitting heat to the hair from the smooth contact surface.

5. The Hair Straightening Device of claim 4, further comprising a second row of teeth extending from the nozzle opening and positioned across the aperture from the row of teeth and substantially parallel thereto.

6. The Hair Straightening Device in claim 5, wherein the heating bar is closer to the row of teeth than the second row of teeth.

7. A method for straightening curly hair, comprising:

attaching a Hair Straightening Device to a blow dryer, the hair straightening device comprising:

a body having a base and a nozzle opening, the body formed with a bore extending from the base to the nozzle opening, the receiver end sized for attachment to a blow-dryer;

a row of teeth adjacent to the nozzle opening; and a heating bar having a leading edge, a trailing edge, and a smooth surface therebetween, the heating bar positioned adjacent to the row of teeth within the nozzle opening;

turning on the blow dryer; and passing the row of teeth through a person's hair wherein the person's hair is drawn across the leading edge of the heating bar and the smooth contact surface of the heating bar contacts the hair thereby straightening the hair.

* * * * *